US011622214B2

(12) United States Patent
Dominijanni et al.

(10) Patent No.: US 11,622,214 B2
(45) Date of Patent: Apr. 4, 2023

(54) EAR TIP WITH WAX GUARD

(71) Applicant: Bose Corporation, Framingham, MA (US)

(72) Inventors: Andrew D. Dominijanni, Waltham, MA (US); Christopher R. Paetsch, Cambridge, MA (US); Ryan Joseph Wexler, Boston, MA (US); Richard Lionel Lanoue, Whitinsville, MA (US)

(73) Assignee: BOSE CORPORATION, Framingham, MA (US)

( * ) Notice: Subject to any disclaimer, the term of this patent is extended or adjusted under 35 U.S.C. 154(b) by 8 days.

(21) Appl. No.: 17/205,766

(22) Filed: Mar. 18, 2021

(65) Prior Publication Data

US 2022/0303700 A1 Sep. 22, 2022

(51) Int. Cl.
*H04R 1/10* (2006.01)
*H04R 25/00* (2006.01)

(52) U.S. Cl.
CPC ..... *H04R 25/654* (2013.01); *H04R 1/1016* (2013.01); *H04R 25/658* (2013.01)

(58) Field of Classification Search
CPC ..... H04R 1/12; H04R 25/652; H04R 25/654
See application file for complete search history.

(56) References Cited

U.S. PATENT DOCUMENTS 4,972,488 A 11/1990 Weiss et al.
7,733,659 B2 * 6/2010 Snider ..... H04R 1/02 361/752
7,876,919 B2 * 1/2011 Ram ..... H04R 1/086 381/328
8,431,204 B2 * 4/2013 Ueki ..... H04R 1/023 156/247
8,670,586 B1 * 3/2014 Boyle ..... H04R 1/1008 381/189
8,761,424 B2 * 6/2014 Wubker ..... H04R 1/1016 381/325
9,118,995 B1 8/2015 Feeley et al.
9,277,336 B2 3/2016 Moller et al.
9,980,067 B2 * 5/2018 Dorn ..... H04R 25/654
10,555,071 B2 * 2/2020 Wakeland ..... H04R 1/347
(Continued)

FOREIGN PATENT DOCUMENTS

EP 2509340 A1 * 10/2012 ..... H04R 25/654
JP 2010226300 A * 10/2010

OTHER PUBLICATIONS

International Search Report and Written Opinion dated Jun. 27, 2022 for PCT/US2022/020944.

*Primary Examiner* — Ryan Robinson
(74) *Attorney, Agent, or Firm* — Bose Corporation

(57) ABSTRACT

An eartip includes a compliant portion that forms at least a portion of a sound channel, and a wax guard that is supported in the compliant portion and is disposed within the sound channel. The wax guard includes a porous, planar body that permits the passage of acoustic energy but inhibits the passage of cerumen therethrough, and a retention member. The retention member is arranged along an outer edge of the planar body and in direct contact with the compliant portion. The retention member includes a plurality of openings. A compliant material that forms the compliant portion permeates the openings in the retention member to assist in retaining the wax guard in the compliant portion.

20 Claims, 8 Drawing Sheets

(56) References Cited

U.S. PATENT DOCUMENTS

| | | | | |
|---|---|---|---|---|
| 10,835,931 | B2 | 11/2020 | Aase et al. | |
| 2008/0298618 | A1 | 12/2008 | Baumann et al. | |
| 2010/0322452 | A1* | 12/2010 | Ladabaum | H04R 25/656 381/375 |
| 2014/0247957 | A1 | 9/2014 | Hagedorn-Olsen et al. | |
| 2018/0000649 | A1* | 1/2018 | Wang | H04R 1/1058 |
| 2019/0111456 | A1* | 4/2019 | Aase | B08B 1/005 |
| 2021/0160627 | A1* | 5/2021 | Dominijanni | H04R 25/652 |

* cited by examiner

EAR TIP WITH WAX GUARD

BACKGROUND

This disclosure relates to an eartip insert for an in-ear acoustic device (e.g., a hearing aid or a headphone), wherein the eartip contains a wax guard. Furthermore, this disclosure relates to an in-ear acoustic device with such an eartip as well as to a method for manufacturing an eartip of this type.

Conventional hearing aids come in a variety of styles and sizes. One such style, is what is commonly referred to as a receiver-in-canal (RIC) style hearing aid. RIC hearing aids generally include an electronics housing that is designed to be worn behind a user's ear and a receiver unit that is electrically and mechanically coupled to the electronics housing via wiring and is configured to sit within the user's ear canal. An amplifier, a battery, one or more microphones and other electronic components are typically arranged in the electronics housing, and an electro-acoustic transducer (a/k/a "receiver") is supported in the receiver unit.

The receiver unit generally has an eartip with a dome-shaped portion that is removably attached to an acoustic module, e.g. via a snap-fit connection. The eartip is typically made of a complaint material at least in the area of the dome-shaped portion. The eartip engages the user's ear canal to help retain the receiver unit in the user's ear. In some cases, the eartip may also provide an acoustic seal with the user's ear canal. Such eartips are known to include cerumen or wax guards that are arranged in an acoustic path between the acoustic module and the user's ear canal and which protect the acoustic module from infiltration of cerumen (earwax) and other debris.

Similar eartips are also used in behind-the-ear (BTE) style hearing aids as well as in-the-ear style (ITE) style hearing aids. BTE hearing aids are similar to the RIC hearing aids described above with the exception being that in the BTE hearing aid the receiver (or speaker) is housed in the electronics housing that sits behind the user's ear and is acoustically coupled to the eartip in the user's ear canal via a tube. ITE hearing aids, on the other hand, generally consist of an earbud that serves an electronics housing—containing all of the hearing aid electronics—that sits at least partially within the user's ear canal and the eartip is coupled directly to a nozzle on the earbud.

Such eartips generally consist of: the dome-shaped portion, an inner portion in the shape of a cylindrical core with retention features for making a snap-fit connection, and the wax guard. A sound channel runs through the inner portion which begins at a sound inlet opening of the eartip and opens out into a sound outlet opening of the eartip or forms the latter. The wax guard is arranged in the area of the sound outlet opening of the eartip. In some cases, the wax guard may be formed integrally with the material that forms the dome-shaped portion and/or the inner portion, e.g., in a molding operation, such as described in U.S. Pat. No. 6,129,174. Such configurations can be desirable as it can simplify manufacturing operations since the dome-shaped portion and the wax guard can be formed at the same time—the wax guard being formed as a membrane with a perforation through it. These configurations are generally acceptable for hearing aids that merely provide for sound amplification, however, the acoustic impedance of such molded perforations is too high to enable good feedback noise cancellation.

In other cases, the wax guard is initially manufactured as separate component from a porous material (e.g., a woven material) that is subsequently coupled to a tubular inner portion formed of a rigid, unyielding plastic material to form a sub-assembly. A dome-shaped portion is then formed of a soft, flexible material around the sub-assembly, e.g., in an injection molding operation, such as described in U.S. Pub. No. 2012/0250923. This not only introduces additional manufacturing steps, but it also relies on the use of a rigid, unyielding material to support the wax guard during the subsequent molding operation.

SUMMARY

All examples and features mentioned below can be combined in any technically possible way.

In one aspect, an eartip includes a compliant portion that forms at least a portion of a sound channel, and a wax guard that is supported in the compliant portion and is disposed within the sound channel. The wax guard includes a porous, planar body that permits the passage of acoustic energy but inhibits the passage of cerumen therethrough, and a retention member. The retention member is arranged along an outer edge of the planar body and in direct contact with the compliant portion. The retention member includes a plurality of openings. A compliant material that forms the compliant portion permeates the openings in the retention member to assist in retaining the wax guard in the compliant portion.

Implementations may include one of the following features, or any combination thereof.

In some implementations, the retention member includes a cupped edge formed integrally with the porous planar body.

In certain implementations, the wax guard is formed from a mesh and the plurality of openings includes open spaces in the mesh.

In some cases, the retention member includes at least one shim adhered to the porous, planar body.

In certain cases, the retention member includes a pair of shims adhered to opposing surfaces of the porous, planar body.

In some examples, the compliant portion defines retention features for making a snap-fit connection with a mating device.

In certain examples, the compliant portion defines: (i) a dome-shaped portion; and (ii) an inner portion in the shape of a cylindrical core with retention features for making a snap-fit connection to a mating device.

In some implementations, the inner portion is formed of a first compliant material having a first durometer, and the dome-shaped portions is formed of a second compliant material have a second durometer that is less than the first durometer.

In certain implementations, the first durometer is 30 Shore A to 60 Shore A, and the second durometer is 15 Shore A to 17 Shore A.

In some cases, the porous, planar body of the wax guard has an acoustic impedance of 6 Rayl to 30 Rayl.

In another aspect, an eartip includes a compliant portion; and a wax guard suspended in the compliant portion. The wax guard includes a cupped edge.

Implementations may include one of the above and/or below features, or any combination thereof.

In some implementations, the wax guard is formed of a porous, planar substrate that is processed to form the cupped edge in the porous substrate.

In certain implementations, the porous, planar substrate comprises a mesh.

In some cases, the porous, planar substrate is a polyimide mesh.

In certain cases, the polyimide mesh is thermoformed to form the cupped edge.

In some examples, the porous, planar substrate is a metal mesh.

In certain examples, the metal mesh is bent to form the cupped edge.

In some implementations, the compliant portion defines: (i) a dome-shaped portion; and (ii) an inner portion in the shape of a cylindrical core with retention features for making a snap-fit connection.

In certain implementations, the inner portion is formed of a first compliant material having a first durometer, and the dome-shaped portions is formed of a second compliant material have a second durometer that is less than the first durometer.

In some cases, the first durometer is 30 Shore A to 60 Shore A, and the second durometer is 15 Shore A to 17 Shore A.

In certain cases, the wax guard has an acoustic impedance of 6 Rayl to 30 Rayl.

Another aspect features a method that includes cutting a wax guard body from a porous, planar substrate; forming a retention member at an outer edge of the wax guard body; and molding a compliant portion of an ear tip directly around the wax guard and such that a compliant material that forms the compliant portion permeates openings in the retention member to assist in retaining the wax guard in the compliant portion.

Implementations may include one of the above and/or below features, or any combination thereof.

In some implementations, the retention member is a cupped edge and forming the retention member includes thermoforming or bending the outer edge of the wax guard body to form the retention member.

In certain implementations, forming the retention member includes attaching at least one shim along the outer edge of the wax guard body.

In some cases, the retention member includes attaching a pair of shims to opposing surfaces along the outer edge of the wax guard body.

In certain cases, forming the retention member includes forming a plurality of holes that extend through the at least one shim. The plurality of holes are the openings in the retention member.

In some examples, molding the compliant portion includes: (i) molding an inner portion of the eartip out of a first compliant material having a first durometer in a first molding operation, such that the first compliant material permeates the openings in the retention member; and (ii) molding a dome-shaped portion, around the inner portion, out of a second compliant material having a second durometer in a second molding operation.

In certain examples, the first durometer is 30 Shore A to 60 Shore A, and the second durometer is 15 Shore A to 17 Shore A.

In some implementations, molding the inner portion includes forming retention features out of the first compliant material for making a snap-fit connection with a mating device.

In certain implementations, molding the compliant portion comprises forming retention features in the compliant portion for making a snap-fit connection with a mating device.

Figure 1:
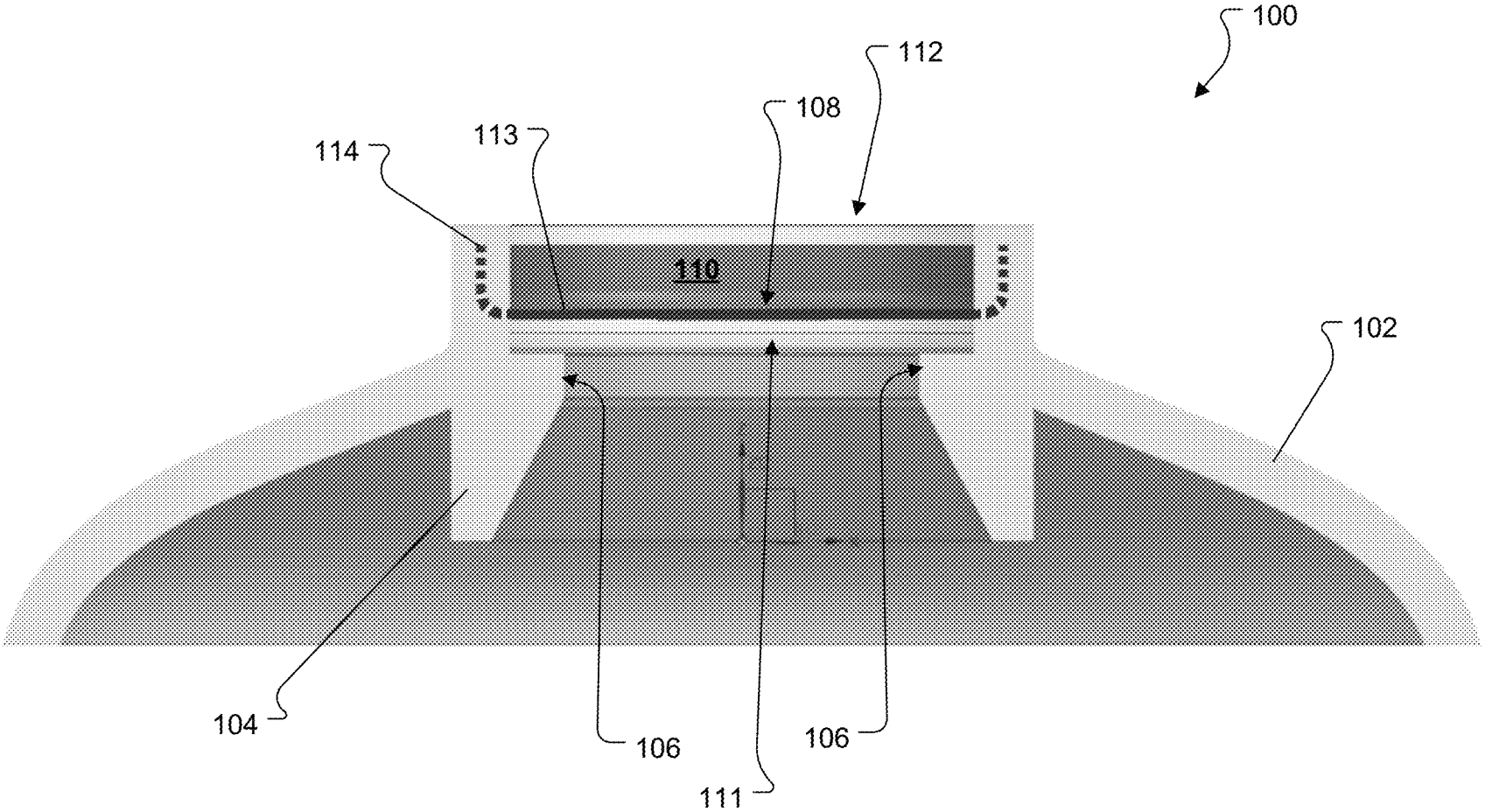
FIG. 1 is a cross-sectional side view of an ear tip in accordance with the present disclosure.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure relates in part to the realization that a wax guard may be formed with features to support the wax guard in a molding operation.

With reference to FIG. 1, an eartip 100 includes a dome-shaped portion 102, an inner portion 104 in the shape of a cylindrical core with retention features 106 for making a snap-fit connection, and a wax guard 108. A sound channel 110 runs through the inner portion 104 which begins at a sound inlet opening 111 of the eartip 100 and opens out into a sound outlet opening 112 of the eartip 100 or forms the latter. The wax guard 108 is arranged in the area of the sound outlet opening 112 of the eartip 100. Notably, the wax guard 108 includes a porous, planar body 113 with a retention member (shown in the form of an integrally formed cupped edge 114 in FIG. 1). This cupped edge 114 structurally supports the wax guard 108 during a molding operation to form the eartip 100 and also helps to retain the wax guard 108 in compliant material that is formed around it during the molding operation. In that regard, the compliant material permeates openings (open spaces in a mesh/screen material) in the retention member which allows for good retention of the wax guard 108 in the compliant material without needing an extra plastic carrier to hold the wax guard 108.

Figure 2:
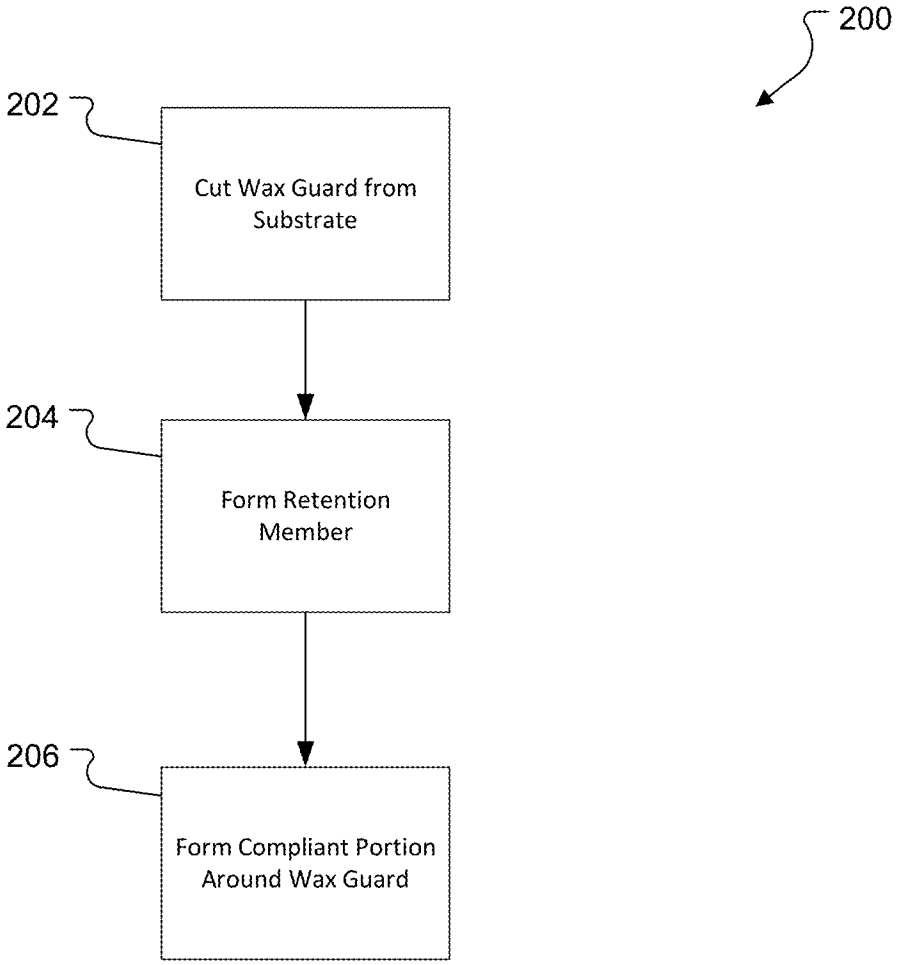
FIG. 2 is a flow diagram for manufacturing the ear tip of FIG. 1.

Referring to FIG. 2, the eartip 100 is formed in a multi-step process 200 that includes:

In a first step, the wax guard is cut from bulk material (e.g., a porous planar substrate, e.g., a woven mesh). In that regard, the wax guard 108 is formed from a porous material, such as a mesh, with low acoustic impedance, i.e., an acoustic impedance of 6 Rayl to 30 Rayl). The use of a low impedance material allows the wax guard 108 to be used in devices that provide for feedback noise cancellation. The wax guard 108 may be a polyimide mesh or a metal mesh. Suitable mesh materials are available under the name SEFAR ACOUSTIC HF mesh from Sefar Inc. of Buffalo, N.Y.

In a second step 204, a retention member is formed. In that regard, with reference to FIG. 1, the cupped edge 114 is formed in the wax guard 108. For example, when a polyimide mesh is used, the cupped edge 114 may be formed in a thermoforming operation. Alternatively, if a metal mesh is used, the cupped edge 114 may be formed in a die forming operation. In some cases, the wax guard may be cut (202) and formed (204) at the same time in a die forming process.

In a third step 206, a compliant portion of the eartip 100 is formed around the cup-shaped wax guard 108. The compliant portion may include the dome-shaped portion 102 and/or the inner portion 104. The compliant portion is formed of a compliant material, such as silicone, polyurethane, polynorbornene (e.g., Norsorex® material available from D-NOV GmbH of Vienna, Austria), thermoplastic elastomer (TPE), and/or fluoroelastomer. The compliant material has a hardness between 15 Shore A and 60 Shore A. The compliant portion may be formed in a molding operation, e.g., an injection molding operation or a compression molding operation. For example, the cup-shaped wax guard 108 can be placed in a mold and liquid silicone rubber can be injected into the mold to form the compliant portion. Alternatively, the cup-shaped wax guard 108 can be placed into a compression mold along with a base material (e.g., silicone or polyurethane) and then pressure is applied to the mold to form the complaint portion. During the molding operation, the compliant material permeates openings in the retention member which helps to retain the wax guard 108 in the compliant portion without the need for an extra plastic carrier to hold the wax guard 108. For example, the wax guard 108 may be formed of a mesh/screen material in which the openings are pores or open spaces in the mesh.

Figure 3:
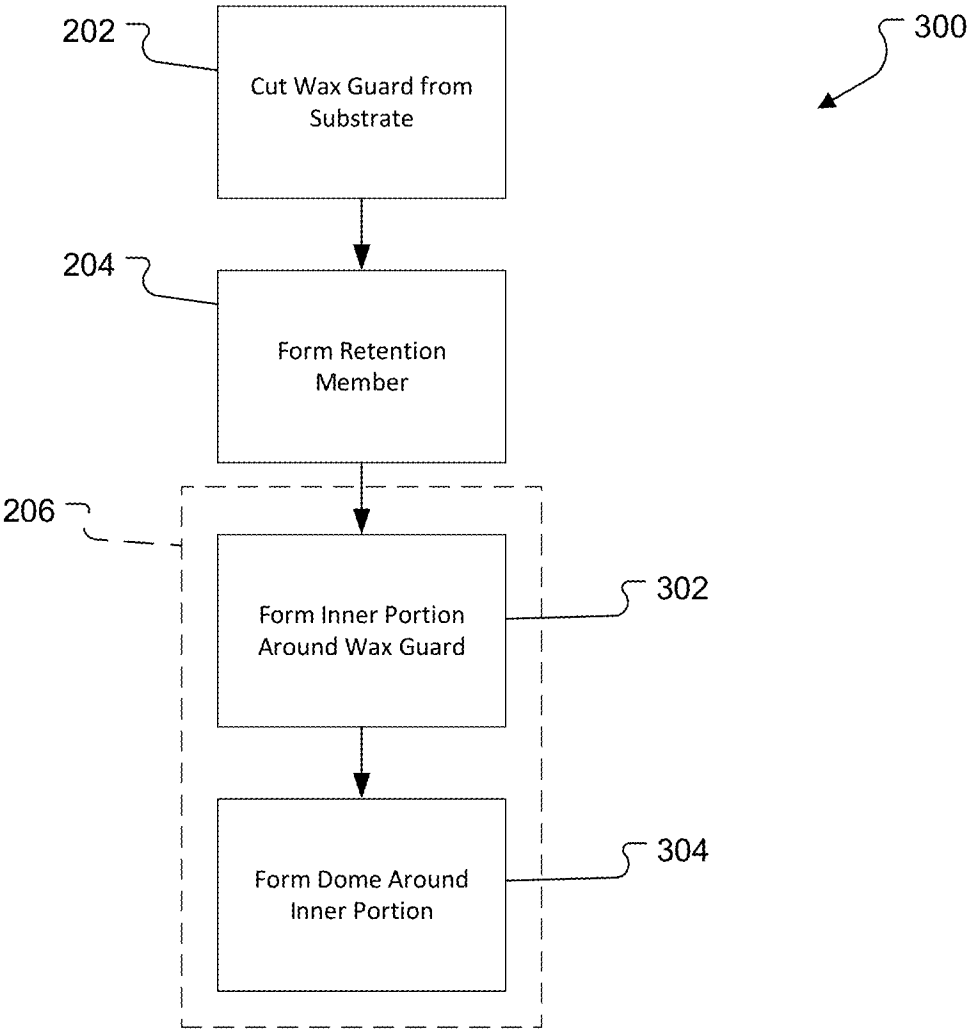
FIG. 3 is a flow diagram for manufacturing another implementation of an ear tip in accordance with this disclosure, as shown in FIG. 4.
Figure 4:
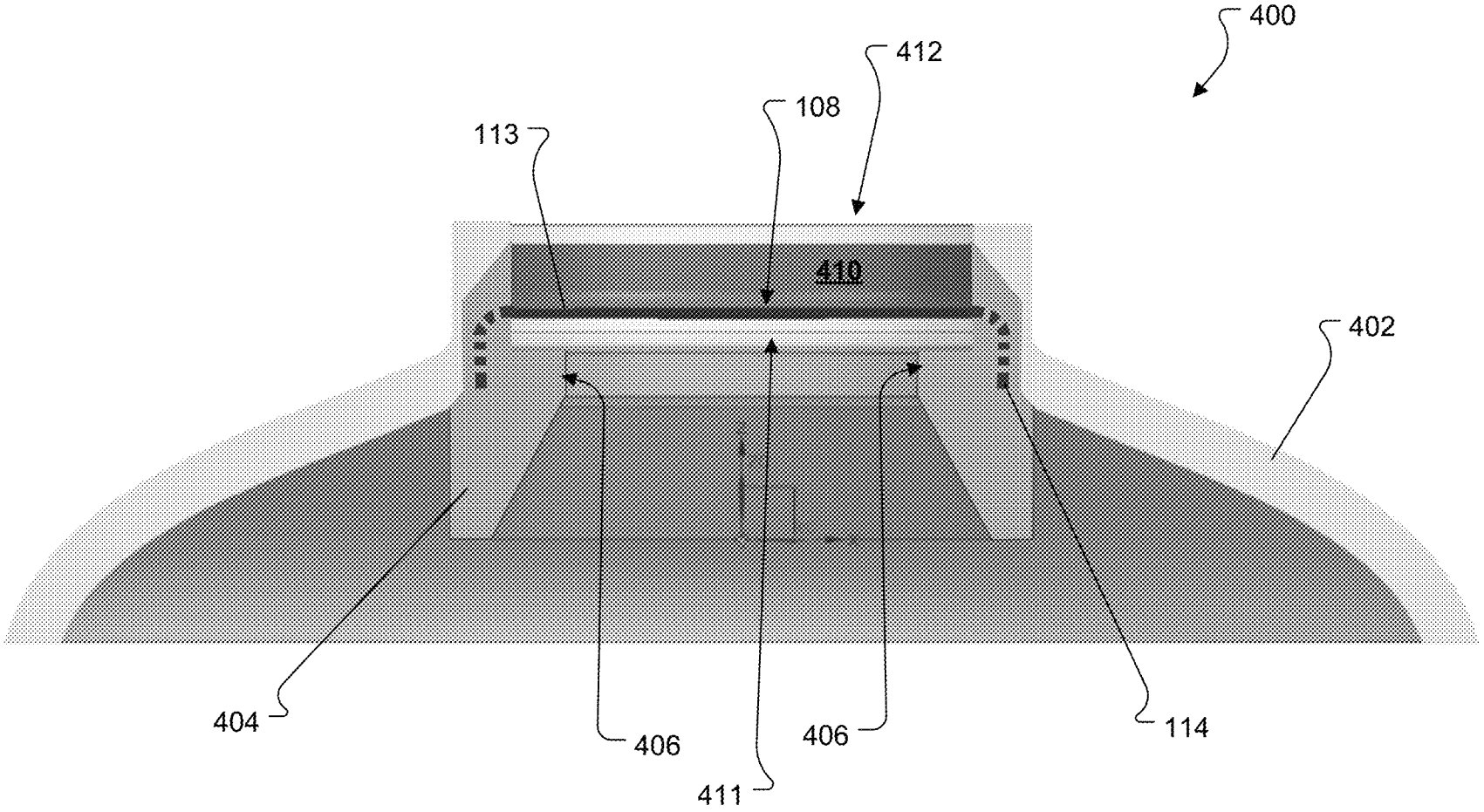
FIG. 4 is a cross-sectional side view of a second implementation of an ear tip in accordance with the present disclosures.

In some cases, the compliant portion is formed in a two-step molding operation. With reference to FIGS. 3 and 4, in a first molding step 302, the cup-shaped wax guard 108 is placed in a first mold and an inner portion 404 in the shape of a cylindrical core with retention features 406 is formed (molded) around the cup-shaped wax guard 108. The first molding operation may include a compression molding operation or an injection molding operation. The inner portion 404 may be formed of a first compliant material, e.g., silicone, polyurethane, polynorbornene (e.g., Norsorex® material available from D-NOV GmbH of Vienna, Austria), thermoplastic elastomer (TPE), and/or fluoroelastomer, having a first durometer, e.g., 30 Shore A to 60 Shore A, to for a sub-assembly that includes the inner portion 404 and the wax guard 108. As in the implementation described above with regard to FIGS. 1 and 2, the first compliant material permeates openings (open spaces in a mesh/screen material) in the retention member which allows for good retention of the wax guard 108 in the first compliant material without needing an extra plastic carrier to hold the wax guard 108.

Then, in a second molding operation 304, a dome-shaped portion 402 is formed (molded) around the sub-assembly. The dome-shaped portion 402 may be formed of a second compliant material, e.g., silicone, polyurethane, polynorbornene (e.g., Norsorex® material available from D-NOV GmbH of Vienna, Austria), thermoplastic elastomer (TPE), and/or fluoroelastomer, having a second durometer, e.g., 15 Shore A to 17 Shore A, that is less than the first durometer. The cupped edge 114 allows the wax guard 108 to be more easily retained in the surrounding compliant material.

A sound channel 410 is formed in the molding process. The sound channel 410 runs through the inner portion 404 which begins at a sound inlet opening 411 of the eartip 400 and opens out into a sound outlet opening 412 of the eartip 400 or forms the latter. The wax guard 108 is arranged in the area of the sound outlet opening 112 of the eartip 100.

The wax guard 108 may be arranged such that the cupped edge 114 faces a sound outlet opening 112/412 of the eartip 100/400, such as shown in FIG. 1. Alternatively, the wax guard 108 may be arranged such that the cupped edge 114 faces away from the sound outlet opening 412 of the eartip 100/400, such as shown in FIG. 4. The latter may be preferred to avoid hard or jagged parts from extending into the ear canal; e.g., less likely to cause harm if the cupped edge 114 of the wax guard 108 cuts through or otherwise breaks free of the surrounding compliant material.

Figure 5:
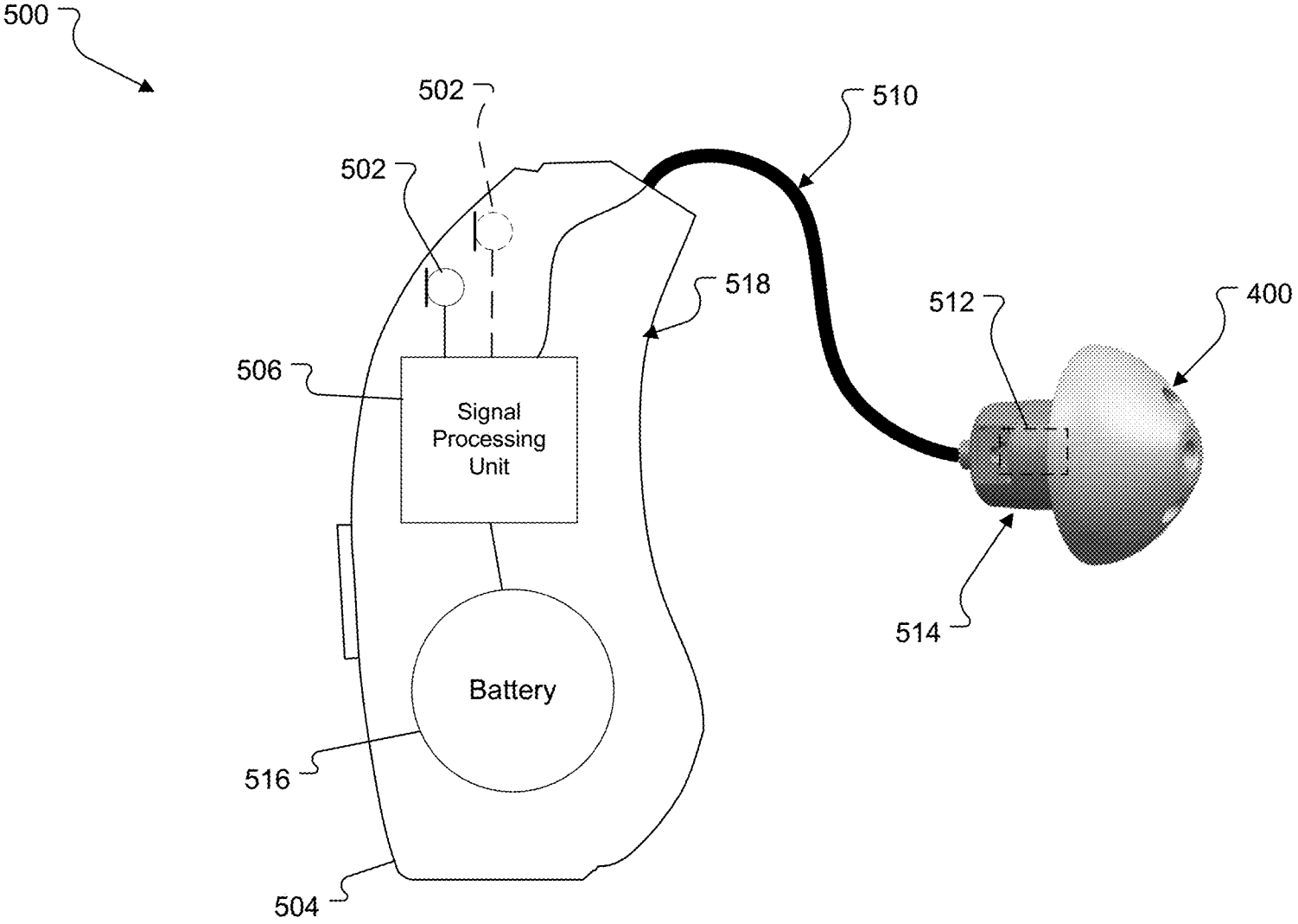
FIG. 5 is a diagrammatic view of a behind-the-ear (BTE) hearing aid with an ear tip in accordance with the present disclosure.

FIG. 5 shows a behind-the-ear (BTE) style hearing aid 500 that incorporates the eartip 400 of FIG. 4. One or more microphones 502 for picking up sound from the surrounding environment are built into a hearing aid housing 504 for wearing behind a user's pinna. A signal processing unit 506 is also supported in the hearing aid housing 504. The signal processing unit 506 processes signals from the microphone(s) 502 and amplifies them. An output signal of the signal processing unit 506 is transferred via wiring 510 to a loudspeaker or receiver 512 in a receiver unit 514, which outputs an acoustic signal to the user's ear canal. Energy is supplied to the hearing aid 500 and especially to the signal processing unit 506 by a battery 516, likewise supported in the hearing aid housing 504.

OTHER IMPLEMENTATIONS

Rather than forming a cupped-edge along the periphery of the wax guard. A rigid member may be attached to the outer periphery of a substantially planar (i.e., flat) porous member (e.g., mesh) to form the retention member, such as illustrate in FIGS. 6A and 6B.

Figure 6A:
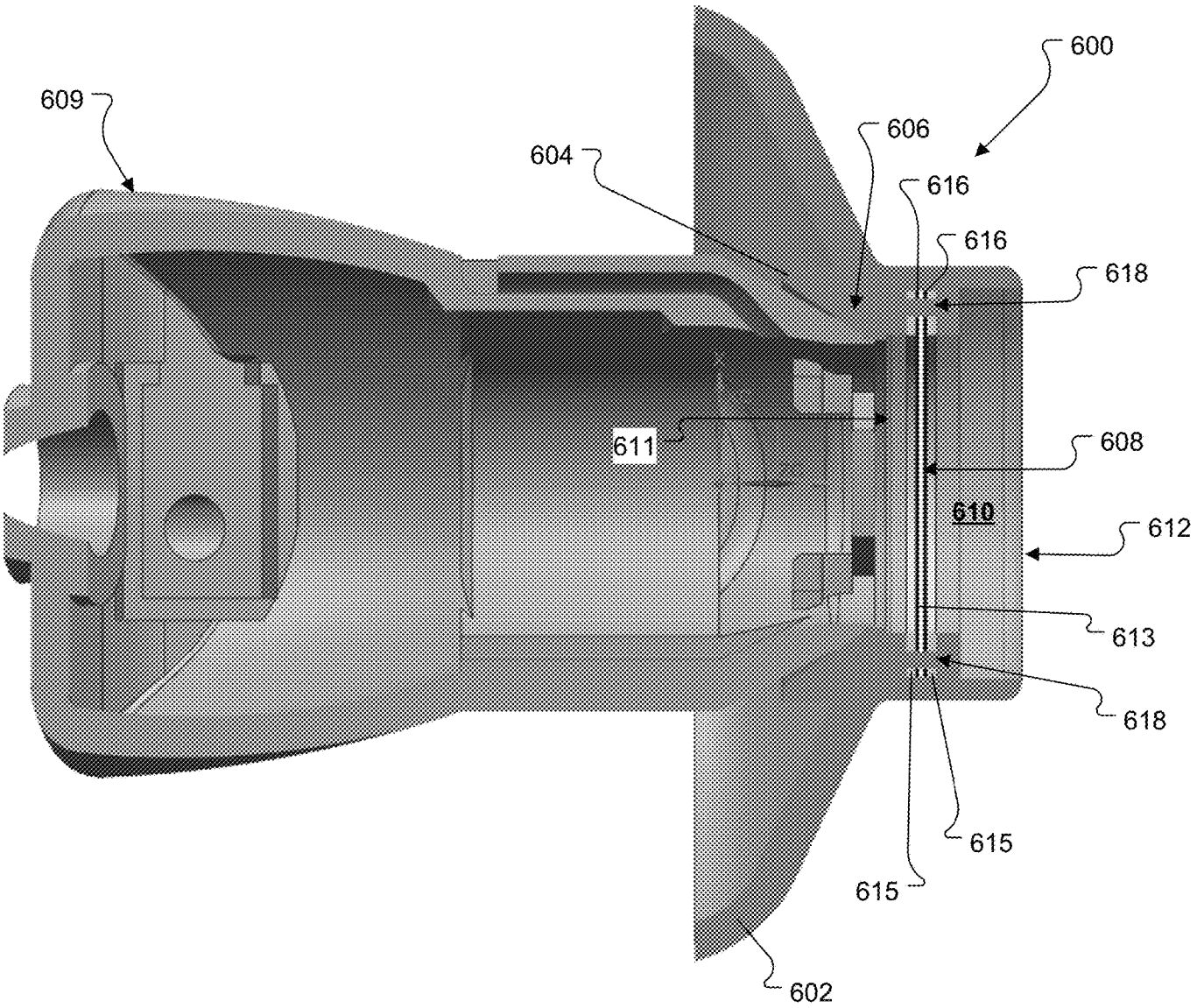
FIG. 6A is a cross-sectional side view of a third implementation of an ear tip in accordance with the present disclosure, shown mounted on a nozzle of an acoustic module.
Figure 6B:
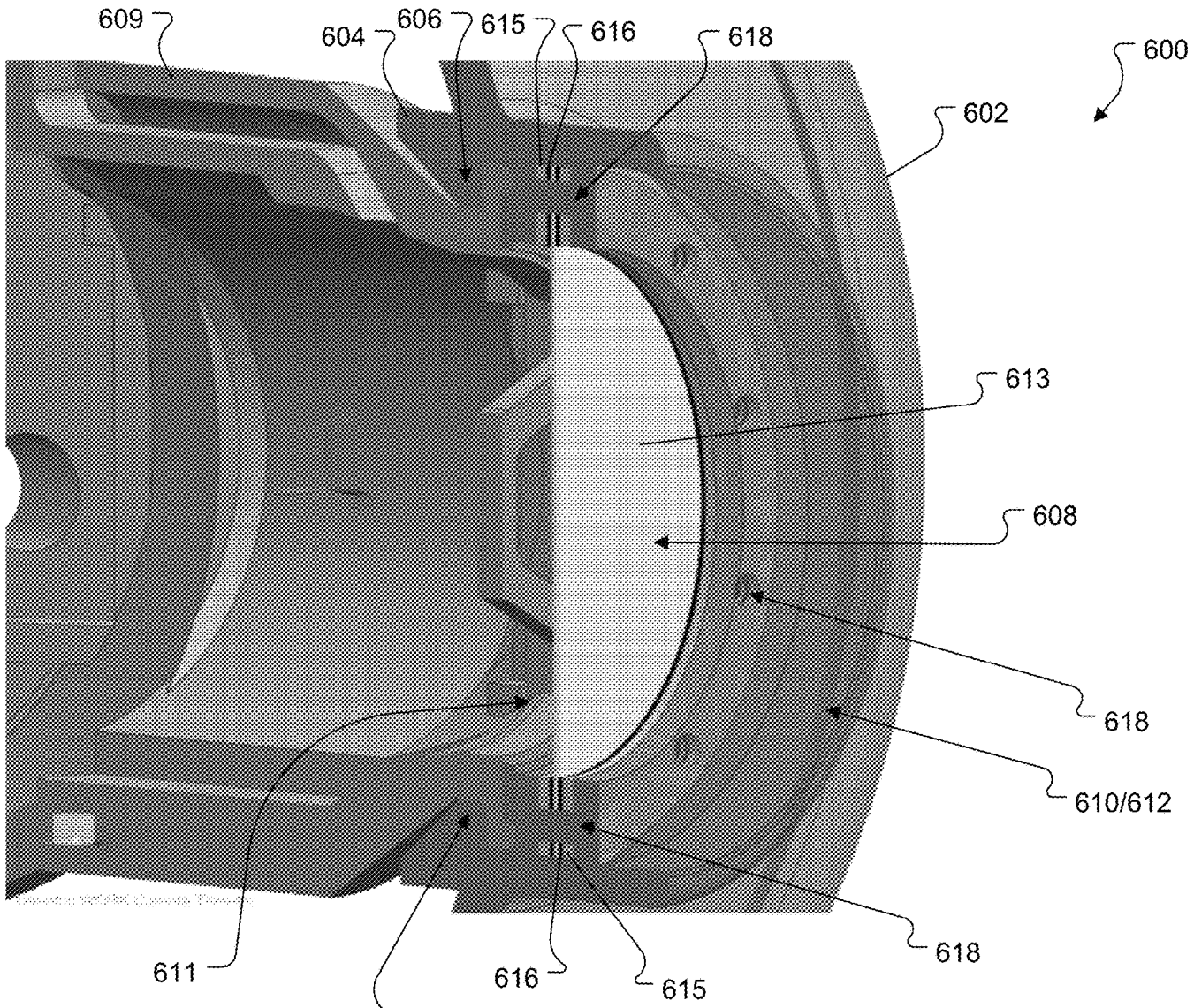
FIG. 6B is a detailed view of the ear tip from FIG. 6A.

FIGS. 6A and 6B illustrate another implementation of an eartip 600 includes a dome-shaped portion 602, an inner portion 604 in the shape of a cylindrical core with retention features 606 for making a snap-fit connection, and a wax guard 608. A sound channel 610 runs through the inner portion 604 which begins at a sound inlet opening 611 of the eartip 600 and opens out into a sound outlet opening 612 of the eartip 602 or forms the latter. The retention features 606 engage mating feature on a nozzle of an acoustic module 609 such that the sound channel 610 is acoustically coupled to a sound outlet opening defined by the acoustic module 609. The wax guard 608 is arranged in the area of the sound outlet opening 612 of the eartip 600. The wax guard 608 includes a porous, planar body 613 with a retention member that is formed from a pair of shims 615 attached on opposing surfaces along the outer edge of the body 613. The shims 615 are shown in the form of flat rings, which may be made of metal. The shims 615 are secured to the body 613 with pressure sensitive adhesive (PSA) 616. Holes 618 are cut (e.g., laser cut) into the shims 615 to allow the compliant material of the eartip 600 to permeate the retention member, which allows for good retention of the wax guard 608 in the compliant material without needing an extra plastic carrier to hold the wax guard 608.

The process for forming the eartip 600 of FIG. 6A may be substantially the same as described above with reference to FIG. 2 or 3, except that, instead of forming the cup-shaped edge, the step of forming the retention member (step 204) would include adhering the shims 615 to the opposing surfaces of the porous, planar body (mesh) with PSA and cutting holes in the retention member (i.e., through the shims 615) to allow the compliant material to flow through those holes 618 in a subsequent molding operation (step 206 or 302). While the implementation illustrated in FIGS. 6A & 6B shows a porous, planar body 613 that is sandwiched between two shims 615, some implementations may include only a single shim 615 on one side of the body 613.

Figure 7:
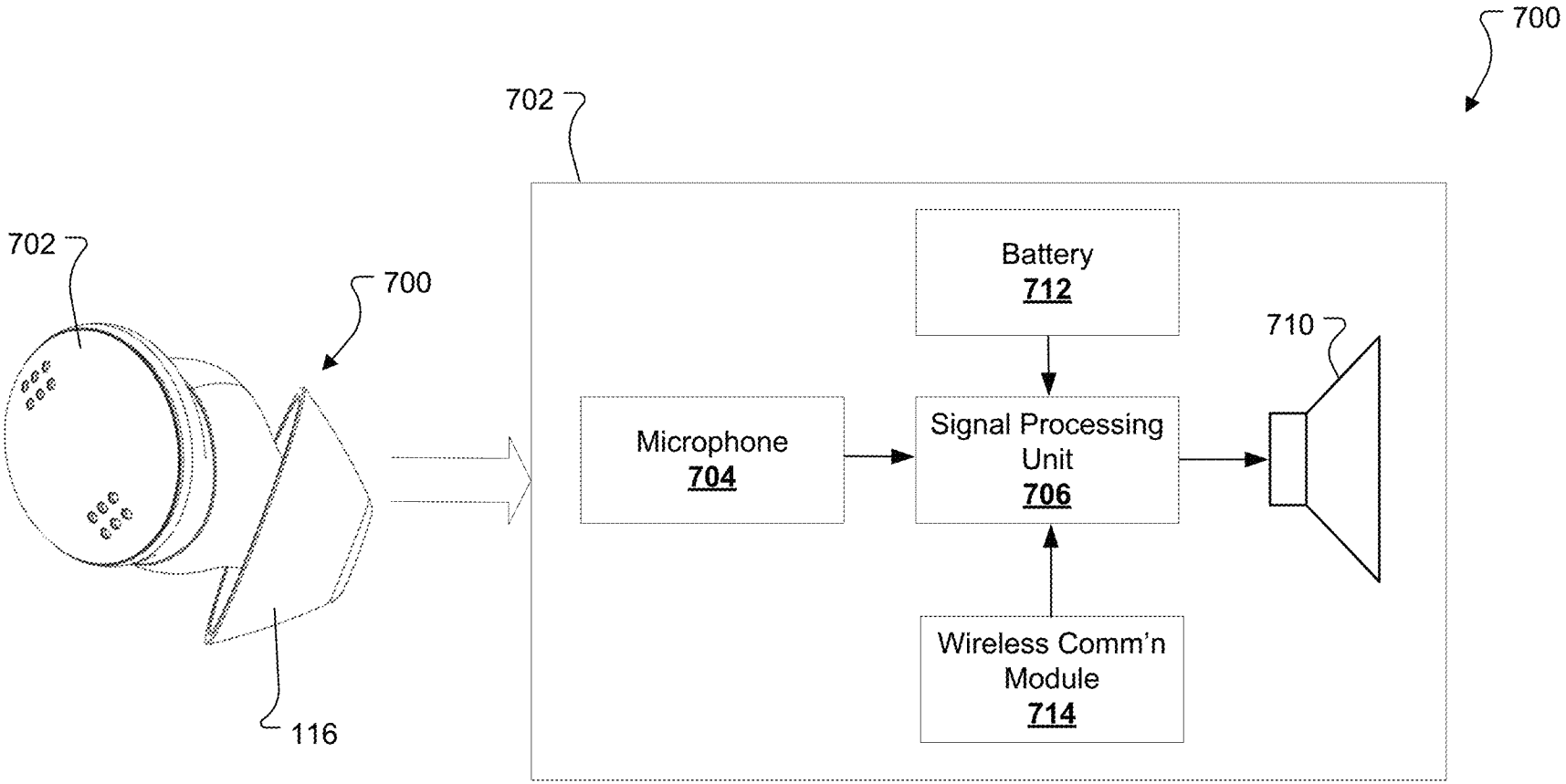
FIG. 7 is a diagrammatic view of an in-ear acoustic device with an ear tip in accordance with the present invention.

While an implementation of a BTE style hearing aid with the eartip of the present disclosure has been described, the eartips described herein may be used with other in-ear acoustic devices (such as in-the-ear (ITE) style hearing aids and in-ear headphones). For example, FIG. 7 illustrates an in-ear acoustic device 700 that includes an earbud 702 that is sized to fit at least partially within a user's ear canal. The earbud 702 houses at least one microphone 704, e.g., for picking up ambient sounds for amplification; a signal processing unit 706 for receiving and processing signals from the microphone 704; a receiver 710 that converts an output signal from the signal processing unit 706 into acoustic energy that is delivered to the user's ear canal; and a battery 712 that supplies power to internal circuitry of the in-ear acoustic device 700 including the signal processing unit 706. The earbud 700 also houses a wireless communication module 714 for communicating with another in-ear acoustic device of a pair and/or with a separate computing device (not shown) via a wireless communication protocol, such as Bluetooth, WiFi, or Zigbee.

An eartip 720, which may include any one of the eartips described above with reference to FIG. 1, 4, or 6A, is supported on a nozzle of the earbud 700; the nozzle defining the sound outlet opening of the earbud 700. The eartip 720 may assist in retaining the hearing aid 202 in the user's ear canal and/or may provide an acoustic seal between the hearing aid 202 and the user's ear canal.

In some cases, the acoustic module or earbud that receives the eartip may also have a wax guard, e.g., an acoustically transparent mesh) arranged at or near its sound outlet opening. This second wax guard offers an additional layer of protection. This second wax guard may be removably attached to a housing so that it can be replaced if it gets occluded.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

Other implementations are within the scope of the following claims and other claims to which the applicant may be entitled.

While various examples have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the examples described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize or be able to ascertain using no more than routine experimentation, many equivalents to the specific examples described herein. It is, therefore, to be understood that the foregoing examples are presented by way of example only and that, within the scope of the appended claims and equivalents thereto, examples may be practiced otherwise than as specifically described and claimed. Examples of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

What is claimed is:

1. An eartip comprising:

I.) a compliant portion forming at least a portion of a sound channel; and

II.) a wax guard supported in the compliant portion and disposed within the sound channel, the wax guard comprising:

a.) a porous, planar body that permits the passage of acoustic energy but inhibits the passage of cerumen therethrough; and b.) a retention member arranged along an outer edge of the planar body and in direct contact with the compliant portion, the retention member including a plurality of openings, wherein a compliant material that forms the compliant portion permeates the openings in the retention member to assist in retaining the wax guard in the compliant portion, and wherein the retention member comprises at least one shim adhered to the porous, planar body.

2. The eartip of claim 1, wherein the wax guard is formed from a mesh and the plurality of openings comprise open spaces in the mesh.

3. The eartip of claim 1, wherein the retention member comprises a pair of shims adhered to opposing surfaces of the porous, planar body.

4. The eartip of claim 1, wherein the compliant portion defines retention features for making a snap-fit connection with a mating device.

5. The eartip of claim 1, wherein the compliant portion defines: (i) a dome-shaped portion; and (ii) an inner portion in the shape of a cylindrical core with retention features for making a snap-fit connection to a mating device.

6. The eartip of claim 5, wherein the inner portion is formed of a first compliant material having a first durometer, and the dome-shaped portion is formed of a second compliant material have a second durometer that is less than the first durometer.

7. The eartip of claim 6, wherein the first durometer is 30 Shore A to 60 Shore A, and the second durometer is 15 Shore A to 17 Shore A.

8. The eartip of claim 1, wherein the porous, planar body of the wax guard has an acoustic impedance of 6 Rayl to 30 Rayl.

9. An eartip comprising:

a compliant portion; and a wax guard suspended in the compliant portion, wherein the wax guard includes a cupped edge, wherein the wax guard is formed of a porous, planar substrate that is processed to form the cupped edge in the porous substrate, wherein the porous, planar substrate is a polyimide mesh, and wherein the polyimide mesh is thermoformed to form the cupped edge.

10. The eartip of claim 9, wherein the compliant portion defines: (i) a dome-shaped portion; and (ii) an inner portion in the shape of a cylindrical core with retention features for making a snap-fit connection.

11. The eartip of claim 10, wherein the inner portion is formed of a first compliant material having a first durometer, and the dome-shaped portion is formed of a second compliant material have a second durometer that is less than the first durometer.

12. The eartip of claim 11, wherein the first durometer is 30 Shore A to 60 Shore A, and the second durometer is 15 Shore A to 17 Shore A.

13. The eartip of claim 9, wherein the wax guard has an acoustic impedance of 6 Rayl to 30 Rayl.

14. A method comprising:

cutting a wax guard body from a porous, planar substrate;

forming a retention member at an outer edge of the wax guard body; and molding a compliant portion of an ear tip directly around the wax guard and such that a compliant material that forms the compliant portion permeates openings in the retention member to assist in retaining the wax guard in the compliant portion, wherein forming the retention member comprises attaching at least one shim along the outer edge of the wax guard body.

15. The method of claim 14, wherein forming the retention member comprises attaching a pair of shims to opposing surfaces along the outer edge of the wax guard body.

16. The method of claim 14, wherein forming the retention member comprises forming a plurality of holes that extend through the at least one shim, wherein the plurality of holes are the openings in the retention member.

17. The method of claim 14, wherein molding the compliant portion comprises:

molding an inner portion of the eartip out of a first compliant material having a first durometer in a first molding operation, such that the first compliant material permeates the openings in the retention member, and molding a dome-shaped portion, around the inner portion, out of a second compliant material having a second durometer in a second molding operation.

18. The method of claim 17, wherein the first durometer is 30 Shore A to 60 Shore A, and the second durometer is 15 Shore A to 17 Shore A.

19. The method of claim 17, wherein molding the inner portion comprises forming retention features out of the first compliant material for making a snap-fit connection with a mating device.

20. The method of claim 14, wherein molding the compliant portion comprises forming retention features in the compliant portion for making a snap-fit connection with a mating device.

* * * * *